US012365563B2

(12) United States Patent
Paddick et al.

(10) Patent No.: US 12,365,563 B2
(45) Date of Patent: Jul. 22, 2025

(54) CABLE REEL

(71) Applicant: Prysmian S.p.A., Milan (IT)

(72) Inventors: Nathan Paddick, Milan (IT); Kris Roberts, Milan (IT)

(73) Assignee: Prysmian S.p.A., Milan (IT)

( * ) Notice: Subject to any disclaimer, the term of this patent is extended or adjusted under 35 U.S.C. 154(b) by 215 days.

(21) Appl. No.: 18/298,255

(22) Filed: Apr. 10, 2023

(65) Prior Publication Data

US 2023/0331513 A1 Oct. 19, 2023

(30) Foreign Application Priority Data

Apr. 15, 2022 (IT) ..... 102022000007622

(51) Int. Cl.
*B65H 75/22* (2006.01)

(52) U.S. Cl.
CPC ..... *B65H 75/2218* (2021.05); *B65H 75/2236* (2021.05); *B65H 75/2263* (2021.05); *B65H 75/2209* (2021.05); *B65H 75/2227* (2021.05); *B65H 75/2245* (2021.05); *B65H 75/2254* (2021.05)

(58) Field of Classification Search
CPC ..... B65H 75/2227; B65H 75/2263; B65H 75/22; B65H 75/2209; B65H 75/2218; B65H 75/2245; B65H 75/2272; B65H 75/28; B65H 75/50; B65H 75/2254; B65H 75/2181
USPC ..... 242/605, 607, 607.1, 608, 608.6, 609, 242/609.1, 609.3
See application file for complete search history.

(56) References Cited

U.S. PATENT DOCUMENTS

| | | | | |
|---|---|---|---|---|
| 3,565,363 | A | 2/1971 | Mizuguchi et al. | |
| 4,895,316 | A | 1/1990 | Salloum | |
| 5,575,437 | A | 11/1996 | Campbell | |
| 5,806,788 | A * | 9/1998 | Witwer | B65H 75/2245 242/118.6 |
| 5,971,317 | A | 10/1999 | Jaros | |
| 6,241,181 | B1 | 6/2001 | Campbell | |
| 2005/0279877 | A1 * | 12/2005 | Lorenzo Barroso | B65H 75/2218 242/608.5 |
| 2009/0008494 | A1 | 1/2009 | Maley | |
| 2009/0090806 | A1 * | 4/2009 | Chen | B65H 75/2227 242/401 |

(Continued)

FOREIGN PATENT DOCUMENTS

| | | | |
|---|---|---|---|
| JP | 62133577 | U | 8/1987 |
| JP | H07228429 | A | 8/1995 |

*Primary Examiner* — Anna M Momper
*Assistant Examiner* — Ermia E. Melika
(74) *Attorney, Agent, or Firm* — Slater Matsil, LLP

(57) ABSTRACT

The present disclosure relates to a cable reel comprising: a tubular main body extending along a longitudinal axis (L), comprising a plurality of tubular sections successively arranged side by side along the longitudinal axis (L) and releasably interconnected one to another; a first flange positioned at a first end of the main body, releasably connected to a first tubular section of the plurality of tubular sections; a second flange positioned at a second end of the main body, releasably connected to a last tubular section of the plurality of tubular sections, wherein each tubular section comprises at least two arcuate sections releasably interconnected in circumferential direction.

19 Claims, 7 Drawing Sheets

(56) References Cited

U.S. PATENT DOCUMENTS

| | | | | |
|---|---|---|---|---|
| 2009/0218436 | A1* | 9/2009 | Charron | B65H 75/2245 242/610.6 |
| 2011/0101153 | A1 | 5/2011 | Brennaman | |
| 2011/0253830 | A1* | 10/2011 | Witwer | B65H 75/2218 242/608.6 |
| 2012/0153069 | A1* | 6/2012 | Allwood | B65H 49/32 242/607 |
| 2019/0276266 | A1* | 9/2019 | Nilsson | B65H 75/2281 |

* cited by examiner

CABLE REEL

CROSS-REFERENCE TO RELATED APPLICATIONS

This application claims the benefit of Italian Patent Application No. 102022000007622, filed on Apr. 15, 2022, which application is hereby incorporated herein by reference.

TECHNICAL FIELD

The present disclosure relates to a cable reel, particularly an expandable and reusable cable reel for packing and transporting cables, such as, for example, fiber drop cables.

BACKGROUND

Optical cables or small sized electrical cables, which need to be packed and transported in coils, are in general wound on reels. For example, drop cables to be installed in a premise (such as a house or an apartment) or externally to a premise to be connected to the main fiber network are usually wound and transported on reels, typically wooden reels, to aid installation. Cable lengths are often significantly different, so different size reels are required. Accordingly, shipment costs have to be incurred when using bulky and heavy reels. Furthermore the reels are not reused and often thrown away, mainly because of volume and/or weight of empty reels in a possible return shipment, which is not sustainable.

U.S. Pat. No. 5,575,437 A discloses a knockdown reel comprising a two-part tubular hub and having a pair of end flanges releasably attached to opposite ends of the tubular hub by latching means capable of being released in order to separate the end flanges from the hub. The two parts of the tubular hub includes complementary tabs to be interlocked together. The tubular hub has fingers interlocking the flanges.

U.S. Pat. No. 3,565,363 A describes a takedown reel comprising a pair of substantially identical rectangular resilient drum-forming plates, a pair of parallel hinges connecting opposite edges of one plate with the corresponding opposite edges of the other plate. The reel is formed by bending the drum-forming plates in the drum form and fitting the flanges at longitudinally opposite ends of the drum while allowing folding of the reel into a compact form by separating the drum from the flanges and flattening the drum plates.

US 2009/0008494 A1 discloses an expandable reel including two parts. Each part is formed by a core and a flange secured to the core. The first and second cores are threadably engageable with each other for thereby drawing the flanges together toward each other to form a spool with the unpackaged coil of wire retained between the flanges.

U.S. Pat. No. 6,241,181 Bi discloses a reusable spool for use in installing electrical wiring. The spool includes first and second mating halves, each having an end plate and a central mandrel. The mandrel of one half may be inserted into a wound coil of wire, which can then be overturned to allow the second half to be connected to the first half. The first and second halves are joined through a plurality of arcuate longitudinal tabs which slidably engage in one position to adjust width and, upon rotation, lock frictionally into a given position.

SUMMARY

Embodiments of this application discuss a cable reel which can be reused after a cable is installed, irrespective of the cable length, and which can be easily dismounted and transported.

Embodiments disclose a cable reel which is both longitudinally and circumferentially modular. The longitudinal modularity allows using the reel for cables having different lengths, whereas the circumferential modularity allows dismounting the reel and packing parts thereof saving space during transportation.

Accordingly, the present disclosure relates to a cable reel comprising a tubular main body extending along a longitudinal axis, comprising a plurality of tubular sections successively arranged side by side along the longitudinal axis and releasably interconnected one to another; a first flange positioned at a first end of the main body, releasably connected to a first tubular section of the plurality of tubular sections; a second flange positioned at a second end of the main body, releasably connected to a last tubular section of the plurality of tubular sections, wherein each tubular section comprises at least two arcuate sections releasably interconnected in circumferential direction.

In an embodiment, all the arcuate sections of all the tubular sections have the same shape and the same dimension and are stackable.

In an embodiment the tubular sections comprise first longitudinal fasteners and second longitudinal fasteners, the first and the second longitudinal fasteners being differently shaped; the first flange and the second flange comprise first flange-fasteners and second flange-fasteners, the first flange-fasteners and the second flange-fasteners being differently shaped, wherein the first longitudinal fasteners are suitable for the releasable connection in longitudinal direction with the second longitudinal fasteners and with the first flange-fasteners, and the second longitudinal fasteners are suitable for the releasable connection with the first longitudinal fasteners and with the second flange-fasteners.

In an embodiment, the first longitudinal fasteners are unsuitable for the connection with the second flange-fasteners, and the second longitudinal fasteners are unsuitable for the connection with the first flange-fasteners.

In an embodiment, the first longitudinal fasteners are positioned on a first longitudinal side of each tubular section and the second longitudinal fasteners are positioned on a second longitudinal side of each tubular section. In some embodiments, each arcuate section comprises both the first and the second longitudinal fasteners. In another embodiment, each tubular section includes at least a first and a second longitudinal fastener on the first longitudinal side and at least a first and a second longitudinal fastener on the second longitudinal side.

In an embodiment, the first flange comprises the first flange-fasteners and the second flange comprises the second flange-fasteners. In another embodiment, each of the first and second flange includes at least a first flange-fastener and a second flange-fastener.

In an embodiment, the first longitudinal fasteners and the second longitudinal fasteners, the first flange-fasteners and the second flange-fasteners comprise snap-fits.

In an embodiment, the first longitudinal fasteners comprise a cantilever snap-fit having a cantilever beam with a tapered hook, and the second longitudinal fasteners comprise an axially protruding wall having a slit, wherein the slit of the second longitudinal fasteners is releasably engageable by the tapered hook of the first longitudinal fasteners.

In an embodiment, the first flange-fasteners comprise an axially protruding wall having a slit, wherein the slit of the first flange-fasteners is releasably engageable by the tapered hook of the first longitudinal fasteners.

In an embodiment, the second flange-fasteners comprise a circumferential slit where the axially protruding wall of the second longitudinal fasteners is insertable, and a cantilever snap-fit having a cantilever beam with a tapered hook, wherein the slit of the second longitudinal fasteners is releasably engageable by the tapered hook of the second flange-fasteners.

In an embodiment, the first and the second flanges are reversibly couplable in a non-working configuration.

In an embodiment, the first flange comprises auxiliary slits where the cantilever beam of the second flange-fasteners can be inserted from the outer side of the first flange such that the hook of the second flange-fasteners engages the slit of the first flange-fasteners for reversibly coupling the first and the second flanges in the non-working configuration.

In an embodiment, the first and/or the second flanges comprise on their inner side an annular space for the insertion of the nearest main body tubular section of the plurality of tubular sections, wherein the annular space is further suitable for the insertion of stacked main body arcuate sections in the non-working configuration.

In an embodiment, each tubular section comprises one or more axial pins on one longitudinal side and one or more axial holes on the other longitudinal side, wherein the axial pins are reversibly insertable into the axial holes, and the first and the second flanges comprise axial holes/axial pins reversibly couplable with the axial pins/axial holes of the main body tubular sections.

In an embodiment, the arcuate sections comprise first circumferential fasteners and second circumferential fasteners, wherein the first circumferential fasteners and the second circumferential fasteners are suitable for the releasable interconnection in circumferential direction, wherein the first and the second circumferential fasteners comprise snap-fits.

In an embodiment, each arcuate section of each tubular section comprises the first circumferential fasteners at a first circumferential end and the second circumferential fasteners at a second circumferential end, wherein the first circumferential fasteners of each arcuate section are suitable for the releasable connection with the second circumferential fasteners of another arcuate section, and vice versa. In another embodiment, at least some arcuate sections comprise the first circumferential fasteners at both the first and second circumferential ends and at least some arcuate sections comprise the second circumferential fasteners at both the first and second circumferential ends.

In an embodiment, the first circumferential fasteners comprise a cantilever snap-fit having a cantilever beam with a tapered hook, and the second circumferential fasteners comprise a circumferentially protruding wall having a slit, wherein the slit of the second circumferential fasteners is releasably engageable by the tapered hook of the first circumferential fasteners.

In an embodiment, the arcuate sections comprise circumferential holes allowing the access to the inside of the tubular main body for decoupling the first longitudinal fasteners and the second longitudinal fasteners, and/or for decoupling the first longitudinal fasteners and the first flange-fasteners, and/or for decoupling the second longitudinal fasteners and the second flange-fasteners, and/or for decoupling the first circumferential fasteners and the second circumferential fasteners.

In an embodiment, the cable reel is made of a plastic material, e.g. polypropylene.

BRIEF DESCRIPTION OF THE DRAWINGS

Further characteristics and advantages will be more apparent from the following description of some embodiments given as a way of an example with reference to the enclosed drawings in which.

DETAILED DESCRIPTION OF ILLUSTRATIVE EMBODIMENTS

In the following description, same alphanumeric references are used for analogous exemplary elements when they are depicted in different drawings.

For the purpose of the present description and of the appended claims, the words "a" or "an" should be read to include one or at least one and the singular also includes the plural unless it is obvious that it is meant otherwise. This is done merely for convenience and to give a general sense of the disclosure.

The present disclosure, in at least one of the aforementioned aspects, can be implemented according to one or more of the following embodiments, optionally combined together.

Figure 1:
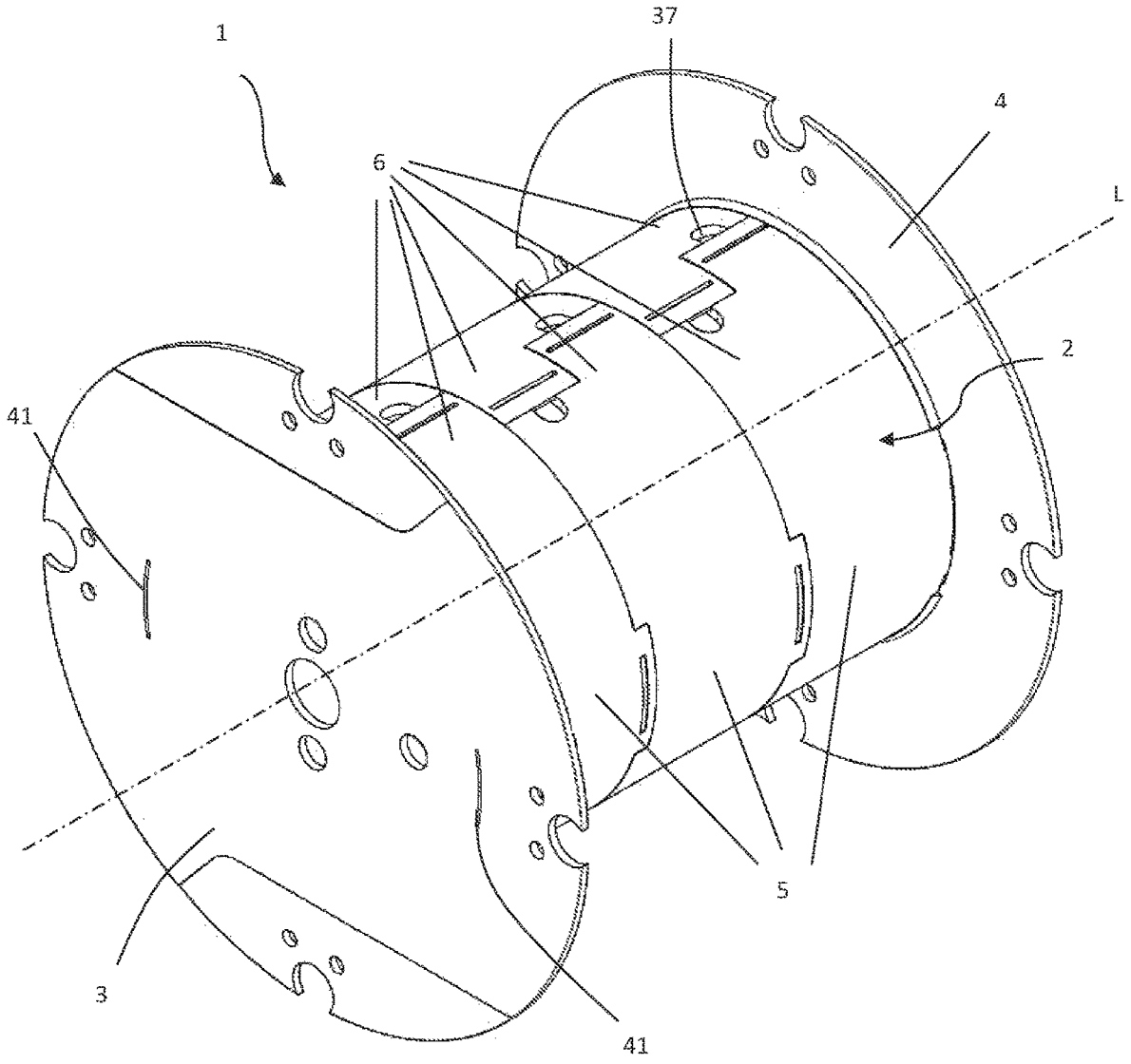
FIG. 1 shows a perspective view of a cable reel in a working configuration according to an embodiment of the present disclosure.
Figure 2:
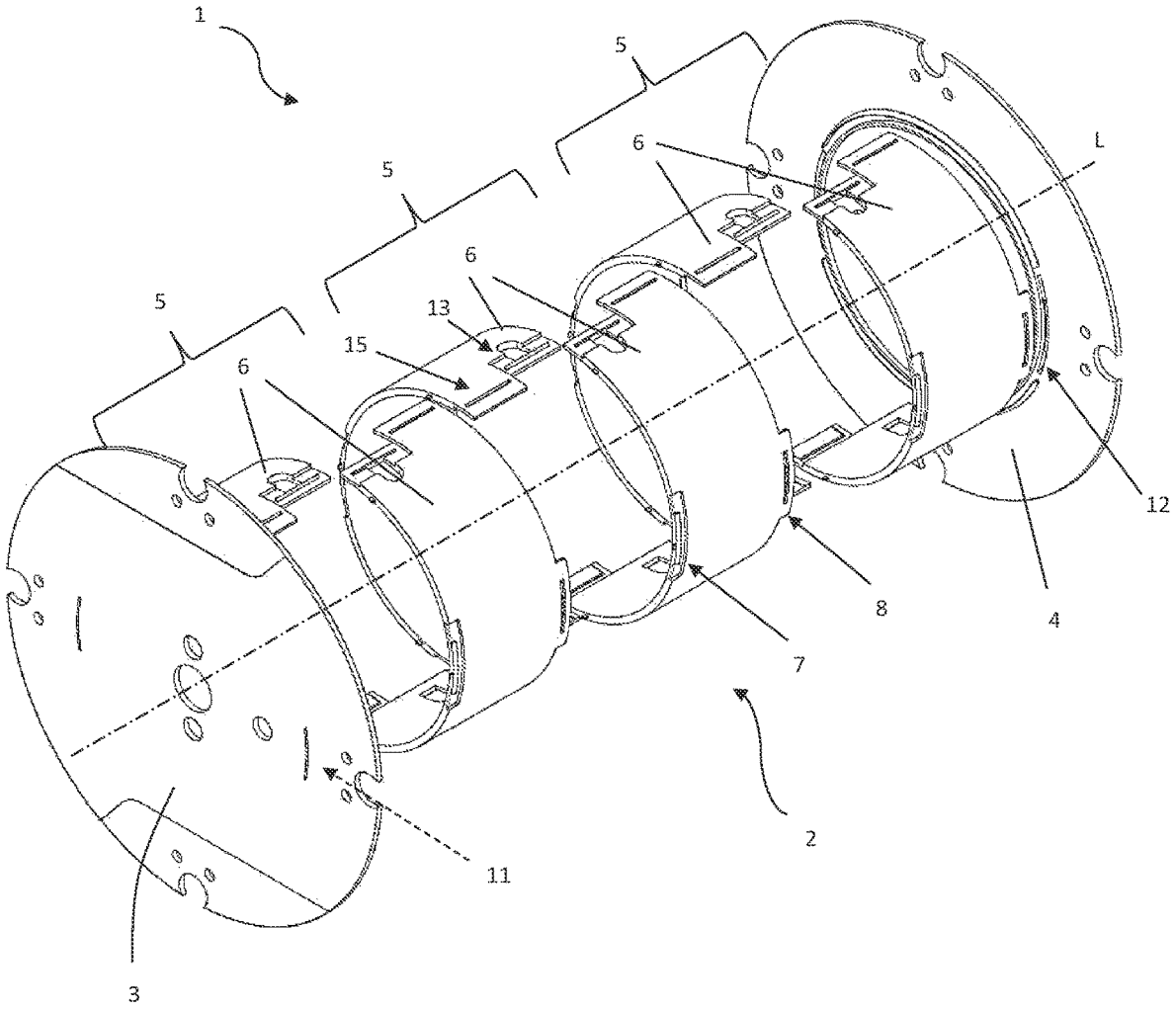
FIG. 2 shows an exploded perspective view of the cable reel shown in FIG. 1.

With reference to the attached FIGS. 1-2, a cable reel is indicated with reference 1. The cable reel 1 according to the embodiment depicted in FIG. 1 is in its working configuration. The reel 1 comprises a tubular main body 2 extending along a longitudinal axis L, and a first flange 3 and a second flange 4 at a first and a second end of the main body 2, respectively. A cable (not shown in the figures), such as a drop cable, can be wound on the main body 2 and the resulting wounded coil can be laterally kept in position on the main body 2 by the two flanges 3, 4. Preferably, the tubular main body 2 has a substantially circular cross section.

It is to be noted that in the present description and in the attached claims, unless differently specified, words such as "cross section", "radial", "axial", "circumferential", "longitudinal", "transversal", or the like are referred to the above-mentioned longitudinal axis L of the main body 2.

The main body 2 comprises a plurality of tubular sections 5, successively arranged side by side along the longitudinal axis L, which can be releasably interconnected one to another. The number of interconnected tubular sections 5 can be modified depending on the length of the cable to be wound on the reel 1. In this manner the reel 1 shows a first modularity along the longitudinal axis L. In some embodiments, as shown in the figures, all the tubular sections 5 have the same shape and the same dimensions, such that all the tubular sections 5 are interchangeable. In other words, they can be interconnected in any order to form the main body 2. All the tubular sections 5 are additionally releasably connectable to both the flanges 3 and 4, as will be described in more detail below.

Each tubular section 5 comprises in turn at least two arcuate sections 6 which are releasably interconnected in circumferential direction. Each tubular section 5 can be formed by exactly two half arcuate sections 6, as shown in the figures, which are circumferentially interconnectable at two ends thereof. This configuration of the arcuate sections 6 allows dismantling each tubular section 5 of the main body 2, thereby reducing the space occupied by the reel 1 when it is disassembled. In an embodiment, the arcuate sections 6 of the same tubular section 5 have the same shape and the same dimensions. Advantageously, all the arcuate sections 6 of all the tubular sections 5 forming the main body 2 are also stackable. This allows an easier packing of the disassembled reel 1 and a reduced amount of space needed, for example during transportation.

Figure 3A:
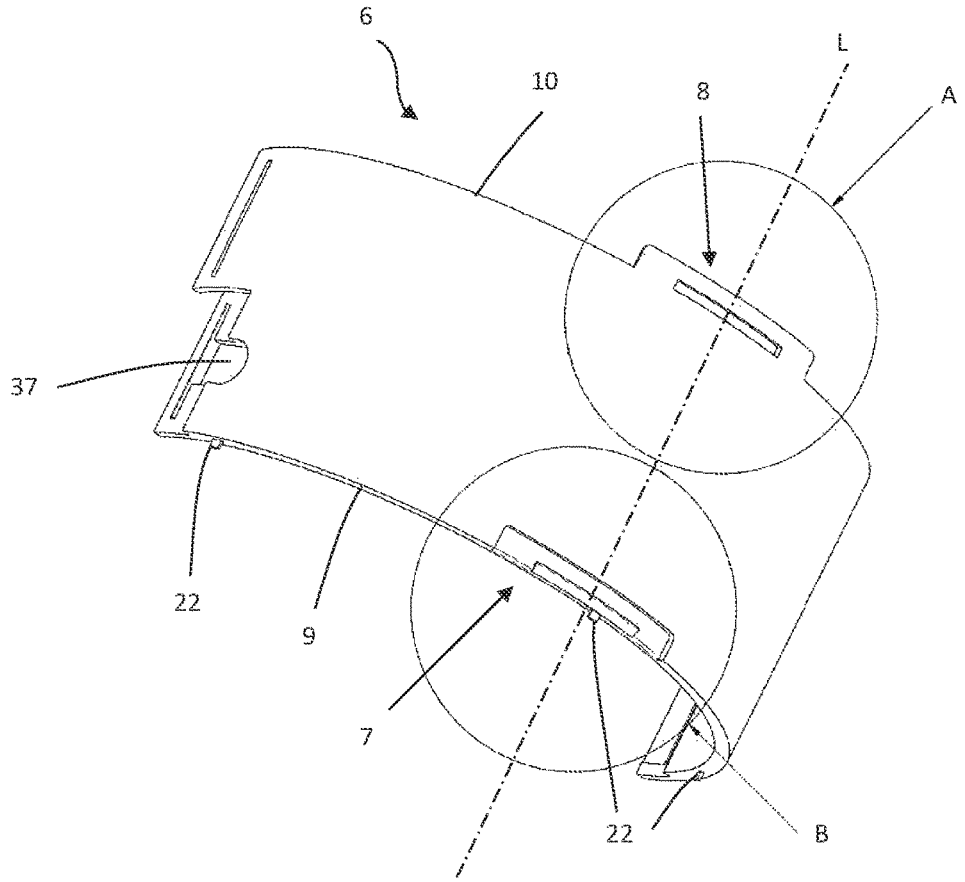
FIG. 3*a* shows a perspective view of an arcuate section of the cable reel in FIG. 1, and FIGS. 3*b* and 3*c* show enlarged details A and B of the same.
Figure 3B:
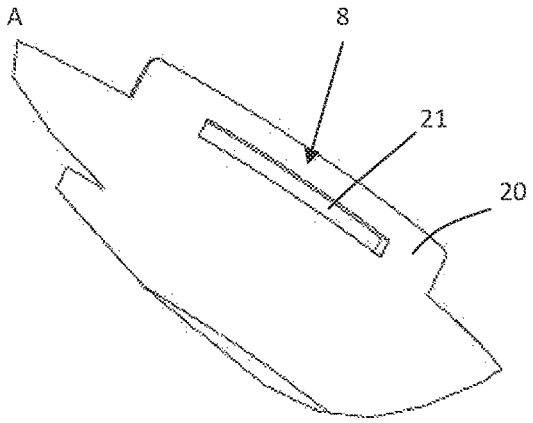
Figure 3C:
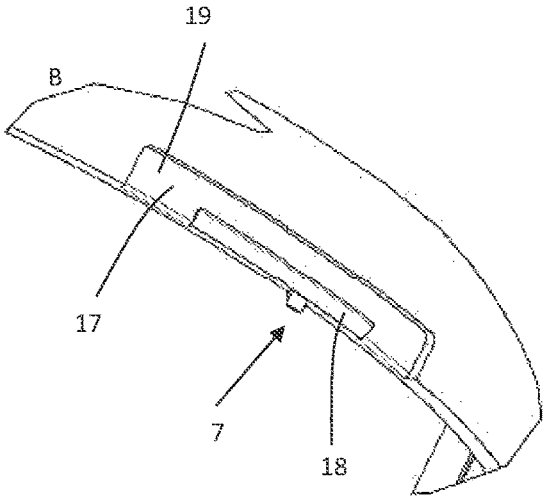

In an embodiment, the tubular sections 5 comprise first 7 and second 8 longitudinal fasteners allowing the releasable coupling of consecutive tubular sections 5 along the longitudinal axis L, wherein the first 7 and the second 8 longitudinal fasteners are different, i.e. differently shaped. In an embodiment, as shown for example in the FIGS. 3*a*-3*c*, the first longitudinal fasteners 7 are positioned on a first longitudinal side 9 of each tubular section 5 and the second longitudinal fasteners 8 are positioned on a second longitudinal side 10 of each tubular section 5. In some embodiments, each arcuate section 6 comprises both the first 7 and the second 8 longitudinal fasteners.

In some embodiments, not shown in the figures, each tubular section 5 includes at least a first 7 and a second 8 longitudinal fastener on the first longitudinal side 9 and at least a first 7 and a second 8 longitudinal fasteners on the second longitudinal side 10.

Additionally, the first flange 3 and the second flange 4 comprise first flange-fasteners 11 and second flange-fasteners 12. In an embodiment, the first flange-fasteners 11 and the second flange-fasteners 12 are different, i.e. differently shaped.

In an embodiment, as shown in the FIGS. 5*a*-5*d* and 6*a*-6*c*, the first flange 3 comprises the first flange-fasteners 11 and the second flange 4 comprises the second flange-fasteners 12. In another embodiment, not shown in the figures, each of the first 3 and second 4 flange includes at least a first flange-fastener 11 and a second flange-fastener 12.

Advantageously, the first longitudinal fasteners 7 are suitable for the releasable connection with the second longitudinal fasteners 8 and with the first flange-fasteners 11, and the second longitudinal fasteners 8 are suitable for the releasable connection with the first longitudinal fasteners 7 and with the second flange-fasteners 12. Preferably, the first longitudinal fasteners 7 are unsuitable for the connection with the second flange-fasteners 12, and the second longitudinal fasteners 8 are unsuitable for the connection with the first flange-fasteners 11.

In an embodiment, the arcuate sections 6 comprise first circumferential fasteners 13 and second circumferential fasteners 15, wherein the first circumferential fasteners 13 are suitable for the releasable connection, in circumferential direction, with the second circumferential fasteners 15, and vice versa.

Figure 4A:
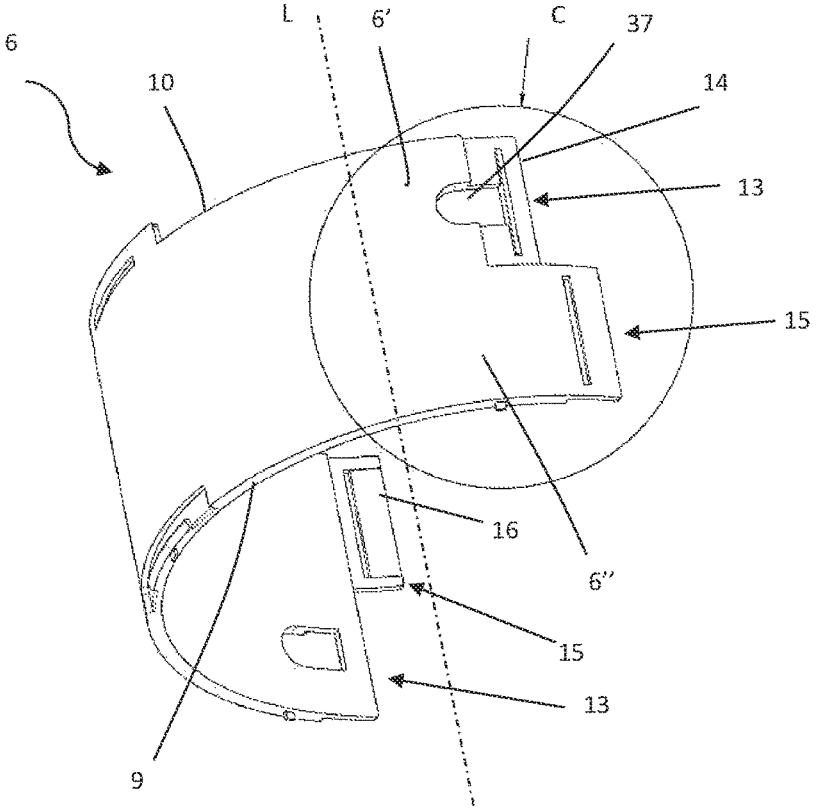
FIG. 4*a* shows another perspective view of the arcuate section of the cable reel in FIG. 3*a*.
Figure 4B:
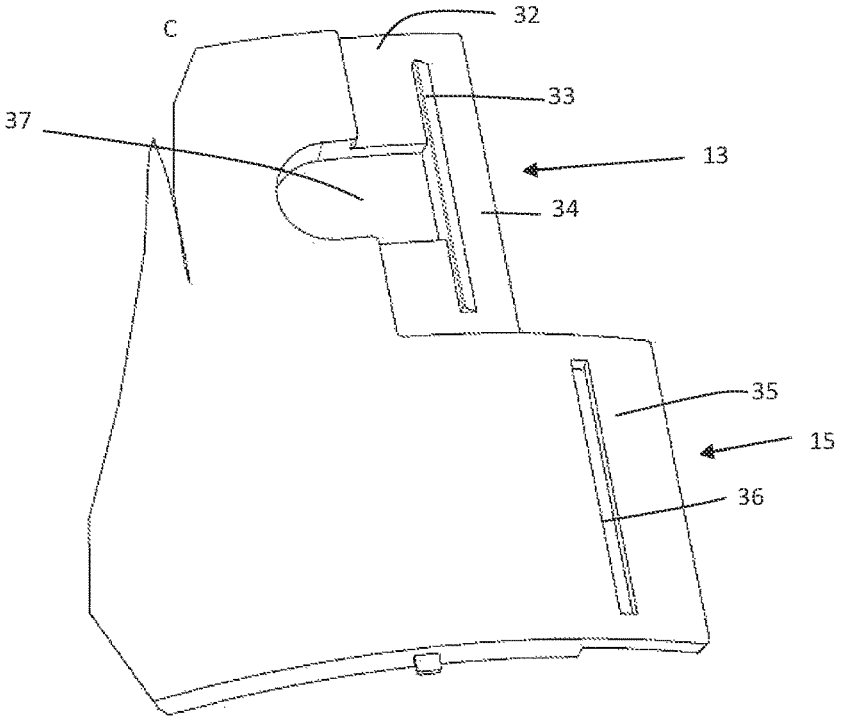
FIG. 4*b* shows an enlarged detail C of the same.
Figure 5A:
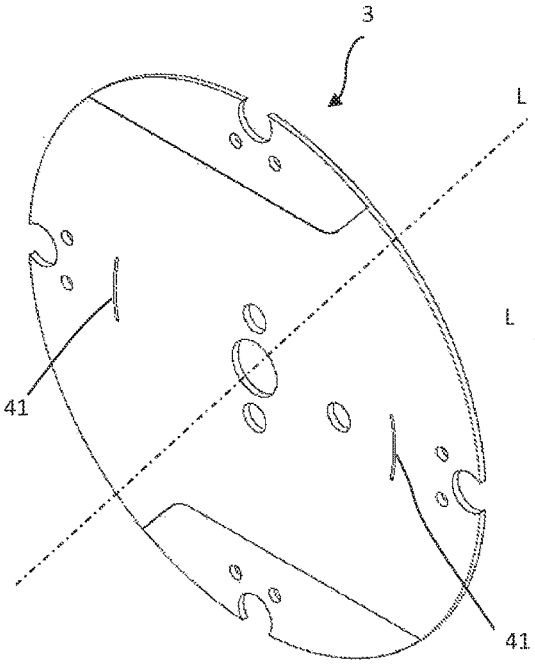
FIGS. 5*a* and 5*b* show perspective views respectively of the outer side and of the inner side of a first flange of the cable reel in FIG. 1, and FIGS. 5*c* and 5*d* show enlarged details D and E of the same.
Figure 5B:
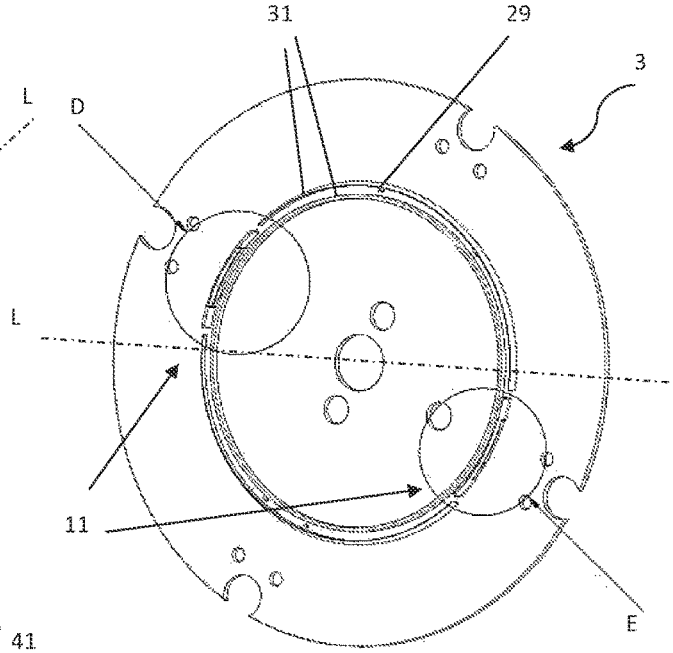
Figure 5C:
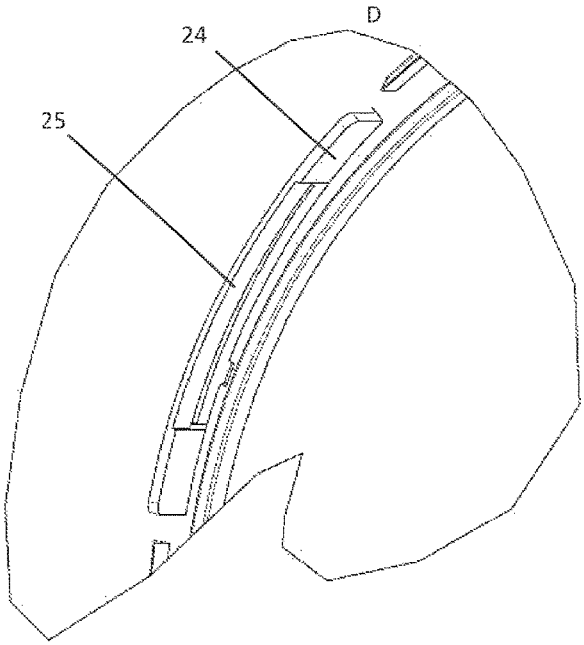
Figure 5D:
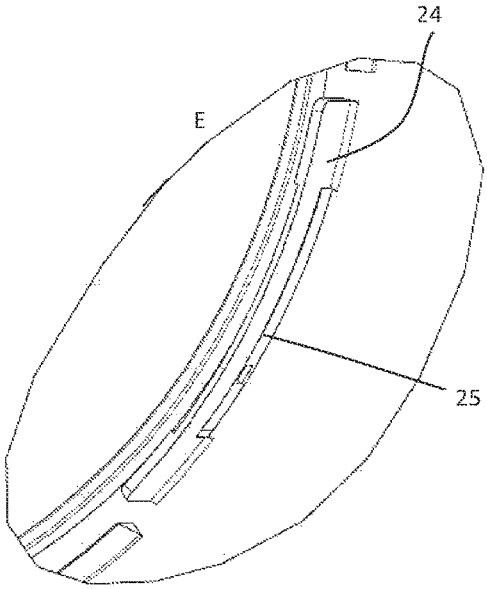

Referring now to the FIGS. 4*a*-4*b*, in an embodiment, each arcuate section 6 of each tubular section 5 comprises the first circumferential fasteners 13 at a first circumferential end 14 and the second circumferential fasteners 15 at a second circumferential end 16, wherein the first circumferential fasteners 13 of each arcuate section 6 are suitable for the releasable connection with the second circumferential fasteners 15 of another arcuate section 6, and vice versa.

In another embodiment, at least some arcuate sections 6 comprise the first circumferential fasteners 13 at both the first and second circumferential ends 14, 16, and at least some arcuate sections 6 comprise the second circumferential fasteners 15 at both the first and second circumferential ends 14, 16.

In the following a description of possible embodiments of the above-mentioned fasteners will be given with reference to the embodiments shown in the attached figures. It is however to be noted that different reversible fasteners not explicitly described, such as screws or bolts, can be alternatively provided for all or some of the fasteners described.

In an embodiment, the first longitudinal fasteners 7 and the second longitudinal fasteners 8 of each tubular section 5, the first flange-fasteners 11 and the second flange-fasteners 12 comprise snap-fits.

Referring again to the FIGS. 3*a*-3*c*, in an embodiment, the first longitudinal fasteners 7 of each tubular section 5, particularly of each arcuate section 6 of each main body 2 tubular section 5, comprise a cantilever snap-fit having a cantilever beam 17 with a tapered hook 18 at or near its end. The cantilever beam 17 develops longitudinally along the longitudinal axis L and circumferentially around the same forming an arc. The tapered hook 18 develops transversally to the longitudinal axis L at the first longitudinal side 9 of the arcuate section 6. Preferably, the cantilever beam 17 corresponds to a part of the arcuate section 6 where the wall forming the same has a reduced width in radial direction. The cantilever beam 17 is preferably both longitudinally and circumferentially shorter than the whole arcuate section 6. Preferably, the cantilever beam 17 is formed on the radially inner side of the arcuate section 6 and the tapered hook 18 protrudes radially outside from the cantilever beam 17. Alternatively, according to an embodiment not shown, the cantilever beam 17 can be formed on the radially outer side of the arcuate section 6 and the tapered hook 18 protrudes radially inside from the cantilever beam 17. Preferably, the tapered hook 18 is shorter than the cantilever beam 17 transversally to the longitudinal axis L. It is to be noted that the so formed cantilever snap-fit, particularly the reduced width cantilever beam 17, forms a coupling seat 19 useful for the fastening with tubular sections 5 as well as with the first flange 3, as will be described in more detail below.

In an embodiment, the second longitudinal fasteners 8 of each tubular section 5, particularly of each arcuate section 6 of each main body 2 tubular section 5, comprise an axially protruding wall 20 (which protrudes in longitudinal direction) having a transversal slit 21. Both the axially protruding wall 20 and the slit 21 develop circumferentially at the second longitudinal side 10 of the arcuate section 6. Preferably, the axially protruding wall 20 corresponds to a part of the arcuate section 6 where the wall forming the same has a reduced width. Preferably, the axially protruding wall 20 is externally flush with the wall forming the arcuate section 6. The axially protruding wall 20 is preferably both longitudinally and circumferentially shorter than the whole arcuate section. Preferably, the axially protruding wall 20 is formed on the radially outer side of the arcuate section 6. Alternatively, according to an embodiment not shown in the figures, the axially protruding wall 20 is formed on the radially inner side of the arcuate section 6. Preferably, the slit 21 is circumferentially shorter than the axially protruding wall 20.

The axially protruding wall 20 has preferably the same axial and circumferential dimensions as the cantilever beam 17, and the slit 21 has dimensions and a position on the axially protruding wall 20 suitable for the engagement by the tapered hook 18 on the cantilever beam 17. Particularly, during coupling of a first and a second consecutive tubular sections 5, the axially protruding wall 20 of a first tubular section slides longitudinally along the longitudinal axis L into the coupling seat 19 of a second tubular section. As a result, the tapered hook 18 of the first tubular section enters in contact with the axially protruding wall 20 of the second tubular section, thereby causing the bending of the cantilever beam 17 of the first tubular section until the tapered hook 18 of the first tubular section engages the slit 21 of the second tubular section, which causes the coupling of the two tubular sections. Preferably, the cantilever beam 17 and the axially protruding wall 20 widths are dimensioned such that, after coupling, the consecutive tubular sections are flush, thereby forming a substantially continuous main body 2 portion, as depicted for example in FIG. 1.

In an embodiment, in order to render the coupling of consecutive main body tubular sections 5 easier, each tubular section 5 comprises one or more axial pins 22 on one of the first 9 and the second 10 longitudinal side and corresponding one or more axial holes (not visible in the figures) on the other of the first 9 and the second 10 longitudinal side, positioned such that when the axial pins 22 of one tubular section 5 enters into the axial bores of another consecutive tubular section 5, the first longitudinal fasteners 7 of one tubular section and the second longitudinal fasteners 8 of the other tubular section are in the right relative position for the coupling.

With reference now to the FIGS. 5*a*-5*d*, the first flange-fasteners 11 can be embodied similarly to the second longitudinal fasteners 8 of the main body tubular sections 5. In particular, in an embodiment, the first flange-fasteners 11 comprise an axially protruding wall 24 with a transversal slit 25 developing circumferentially at one side of the first flange 3, preferably the inner side (i.e. the side facing the main body 2 when the reel 1 is in the working configuration). Preferably, the slit 25 is circumferentially shorter than the axially protruding wall 24. The axially protruding wall 24 has preferably the same axial and circumferential dimensions of the cantilever beam 17 of the first longitudinal fasteners 7 and the slit 25 has preferably the same axial and circumferential dimensions of the tapered hook 18 of the first longitudinal fasteners 7. Additionally, the slit 25 is positioned on the axially protruding wall 24 so to be engageable by the tapered hook 18 on the cantilever beam 17 of the first longitudinal fasteners 7. Particularly, during coupling of the first flange 3 with a main body 2 tubular section 5, the axially protruding wall 24 slides longitudinally along the longitudinal axis L into the coupling seat 19 of the tubular section 5. As a result, the tapered hook 18, radially protruding outside (or inside) the cantilever beam 17, enters in contact with the radially inner (or outer) side of the axially protruding wall 24, thereby causing the bending of the cantilever beam 17 until the tapered hook 18 engages the slit 25, which causes the coupling. Preferably, the cantilever beam 17 and the axially protruding wall 24 widths are dimensioned such that, after coupling, the axially protruding wall 24 is flush with the coupled main body tubular section.

Figure 6A:
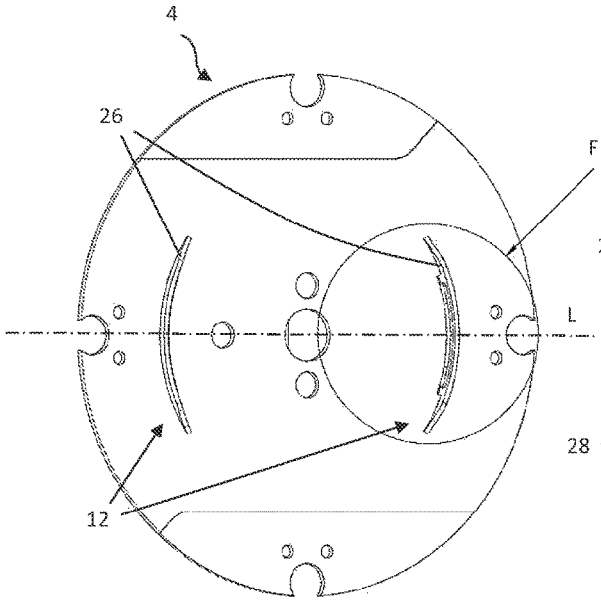
FIGS. 6*a* and 6*b* show a perspective and a side view respectively of the outer side and of the inner side of a second flange of the cable reel in FIG. 1.
Figure 6B:
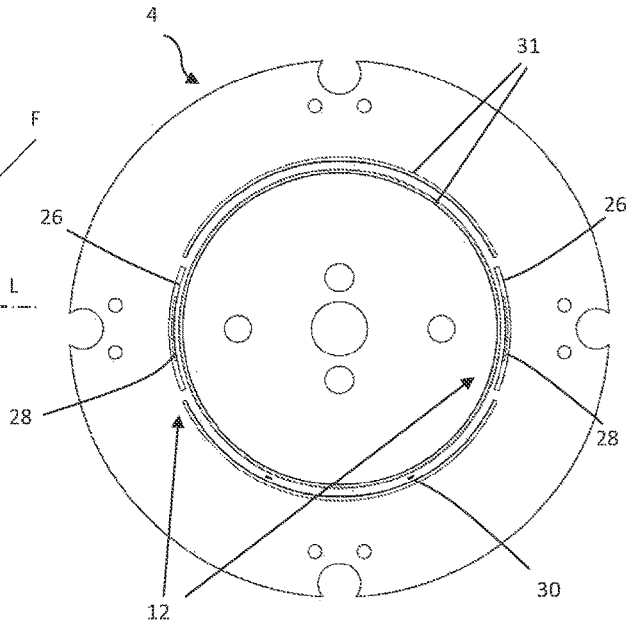
Figure 6C:
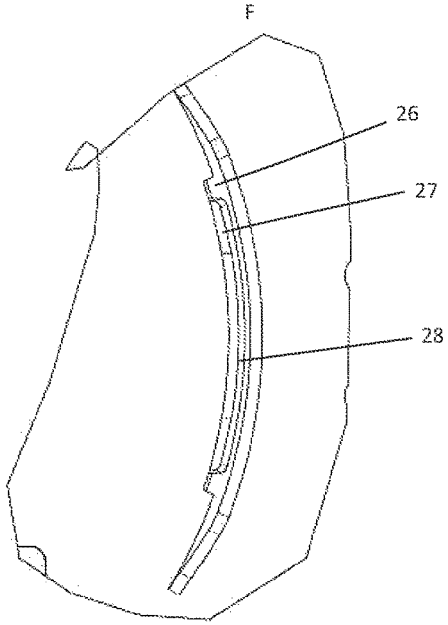
FIG. 6*c* shows an enlarged detail F of the same.

With reference now to the FIGS. 6*a*-6*c*, in an embodiment, the second flange-fasteners 12 comprise a circumferential slit 26 in the second flange 4 where the axially protruding wall 20 of the second longitudinal fasteners 8 can be inserted. It is to be noted that, advantageously, the axially protruding wall 20 of the second longitudinal fasteners 8 is axially long enough to axially protrude from the outer side (i.e., the side opposite to the inner side facing the main body 2) of the second flange 4 once inserted into the circumferential slit 26, such that the slit 21 of the second longitudinal fasteners 8 is accessible preferably on the inner side of the second flange 4. The second flange-fasteners 12 in turn comprise a cantilever snap-fit having a cantilever beam 27 with a tapered hook 28 near or at its end. The cantilever beam 27 develops longitudinally along the longitudinal axis L, preferably on the second flange 4 inner side, and circumferentially around the same longitudinal axis L forming an arc. The tapered hook 28 develops transversally to the longitudinal axis L. Preferably, the cantilever beam 27 is formed on the radially inner side of the circumferential slit 26 and the tapered hook 28 protrudes radially outside from the cantilever beam 27 (or vice versa). In this manner, once the axially protruding wall 20 of the second longitudinal fasteners 8 is fully inserted into the circumferential slit 26, the hook 28 engages the slit 21 of the second longitudinal fasteners 8 thereby coupling a main body tubular section 5 with the second flange 4.

In an embodiment, the first 3 and the second 4 flanges comprise axial holes 29/pins 3*o* couplable with the axial pins 22/holes of the main body tubular sections 5.

In an embodiment, the first 3 and/or the second 4 flanges comprise in their inner sides a couple of axially protruding annular walls 31, forming an annular space for the insertion of the nearest main body tubular sections 5 on the first longitudinal side 9 (in the first flange 3) or in the second longitudinal side 10 (in the second flange 4). The annular walls 31 can be useful also when the reel is in a non-working configuration, as will be described later.

With reference now to the first 13 and the second 15 circumferential fasteners, turning back to FIGS. 4*a*-4*b*, in an embodiment they comprise snap-fits, too.

In an embodiment, the first circumferential fasteners 15 of each arcuate section 6 of each main body 2 tubular section 5 comprise a cantilever snap-fit having a cantilever beam 32 with a tapered hook 33 at or near its end. The cantilever beam 32 protrudes circumferentially at the first circumferential end 14 of the arcuate section 6 and the tapered hook 33 develops transversally to the circumferential direction. In some embodiments, the cantilever beam 32 corresponds to a part of the arcuate section 6 where the wall forming the same has a reduced width. Preferably, the cantilever beam 32 is formed on the radially inner side of the arcuate section 6 and the tapered hook 33 protrudes radially outside from the cantilever beam 32 (or vice versa). Preferably, the cantilever beam 32 is larger than the tapered hook 33. The so formed cantilever snap-fit, particularly the reduced width cantilever beam 32, forms a coupling seat 34 useful for the coupling in circumferential direction with another consecutive arcuate section 6, as will be described in more detail below.

In an embodiment, the second circumferential fasteners 15 of each arcuate section 6 of each main body 2 tubular section 5 comprise a circumferentially protruding wall 35 having a transversal slit 36. In some embodiments, the circumferentially protruding wall 35 corresponds to a part of the arcuate section 6 where the wall forming the same has a reduced width. Preferably, the circumferentially protruding wall 35 is formed on the radially outer (or inner) side of the arcuate section 6.

The circumferentially protruding wall 35 has preferably the same axial and circumferential dimensions as the cantilever beam 32, and the slit 36 has the same axial and circumferential dimensions of the tapered hook 33. Additionally, the slit 36 is positioned on the circumferentially protruding 35 wall so to be engageable by the tapered hook 33 on the cantilever beam 32. Particularly, during the circumferential coupling of two consecutive arcuate sections 6, the circumferentially protruding wall 35 of the first arcuate section slides into the coupling seat 34 of the second arcuate section. As a result, the tapered hook 33 of the first arcuate section enters in contact with the circumferentially protruding wall 32 of the second arcuate section, thereby causing the bending of the cantilever beam 32 until the tapered hook 33 engages the slit 36, which causes the coupling. Preferably, the cantilever beam 32 and the circumferentially protruding wall 33 widths are dimensioned such that, after coupling, the coupled consecutive arcuate sections are flush, as depicted for example in FIG. 1.

It is to be noted that, in an embodiment, each arcuate section 6 comprises at least two modules 6', 6" axially arranged side by side, such that on both the first 14 and the second 16 circumferential ends of the arcuate section, the first module 6' comprises the first circumferential fasteners 13 and the second module 6" comprises the second circumferential fasteners 15. In an embodiment, the first 13 and the second 15 circumferential fasteners on the same circumferential end are circumferentially offset. The first 6' and the second 6" modules are preferably formed in one piece, i.e. the arcuate section 6 comprising the modules 6' and 6" is formed in one single piece.

In an embodiment, the arcuate sections 6 comprise circumferential holes 37 formed near the fasteners, in particular near the snap-fits, allowing an easy decoupling of the same by the user. The circumferential holes 37 allows the user to have access to the inside of the tubular main body 2 when the tubular sections 5 and the arcuate sections 6 are connected so to easily decouple them by disengaging the tapered hooks 18 and the slits 21.

Figure 7A:
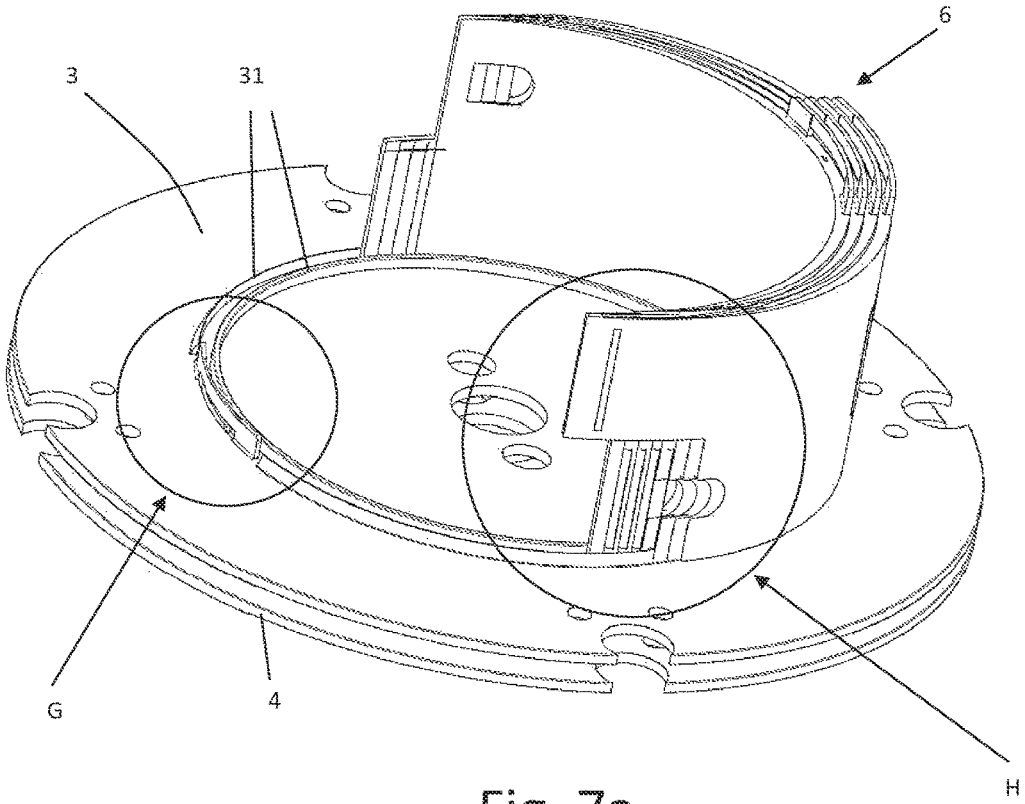
FIG. 7*a* shows a perspective view of the cable reel in FIG. 1 in a non-working configuration.
Figure 7B:
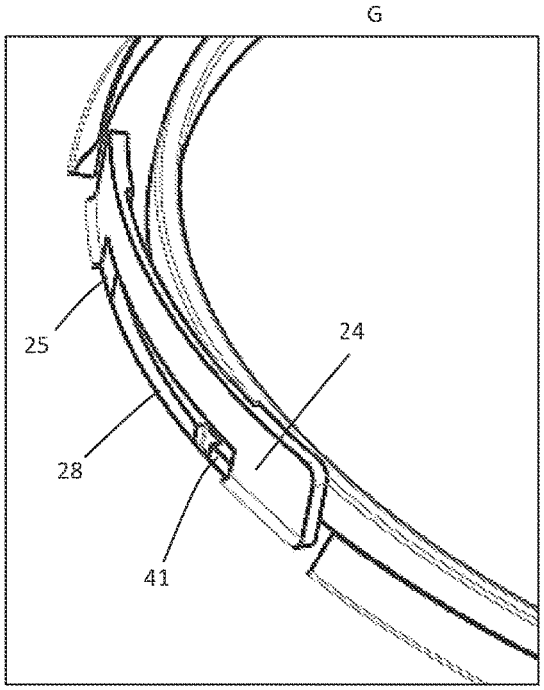
FIGS. 7*b* and 7*c* show enlarged details G and H of the same.
Figure 7C:
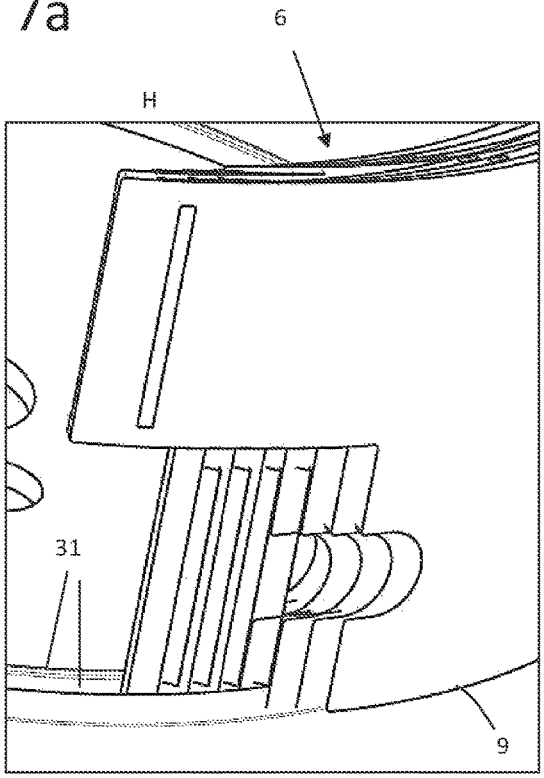

When the reel 1 is not in use (non-working configuration), the arcuate sections 6 and the flanges 2, 3 can be interconnected in a different way in order to save space, e.g. during transportation. An example of a possible non-working configuration is depicted in the FIGS. 7*a*-7*c* (vs. the working configuration depicted in the FIG. 1).

In particular, in the non-working configuration the cantilever beam 27 on the inner side of the second flange 4 can be inserted through auxiliary circumferential slits 41 formed in the first flange 3 (to this regard, see also the FIG. 1 and the FIGS. 5*a*-5*d*) from the outer side of the latter until the hook 28 of the second flange 4 engages the transversal slit 25 on the axially protruding wall 24 of the first flange 3, with the inner side of the second flange 4 facing the outer side of the first flange 3. This allows releasably interconnecting the first 3 and the second 4 flanges together. Then, all the main body arcuate sections 6 can be stacked and positioned onto the first flange 3 on the inner side thereof. Particularly, at least some of the stacked arcuate sections 6 can be inserted at their first longitudinal sided 9 in the annular space formed by the couple of axially protruding annular walls 31 on the inner side of the first flange 3.

The reel 1, including the main body 2 and the flanges 3, 4, as well as all the fasteners, can be made of a plastic material, such as polypropylene.

What is claimed is:

1. A cable reel comprising:

a tubular main body extending along a longitudinal axis, the main body comprising a plurality of tubular sections successively arranged side by side along the longitudinal axis and releasably interconnected to one to another;

a first flange positioned at a first end of the main body, releasably connected to a first tubular section of the plurality of tubular sections; and a second flange positioned at a second end of the main body, releasably connected to a last tubular section of the plurality of tubular sections, wherein each tubular section comprises at least two arcuate sections releasably interconnected in a circumferential direction, wherein one of the first and the second flanges comprise on its inner side an annular space for insertion of the nearest main body tubular section of the plurality of tubular sections, wherein the annular space is configured for insertion of stacked arcuate sections in a non-working configuration.

2. The cable reel of claim 1, wherein all the arcuate sections of all the tubular sections have the same shape and the same dimension and are stackable.

3. The cable reel of claim 1, wherein:

the tubular sections comprise first longitudinal fasteners and second longitudinal fasteners, the first and the second longitudinal fasteners being differently shaped; and the first flange and the second flange comprise first flange-fasteners and second flange-fasteners, the first flange-fasteners and the second flange-fasteners being differently shaped, wherein the first longitudinal fasteners are suitable for the releasable connection in longitudinal direction with the second longitudinal fasteners and with the first flange-fasteners, and the second longitudinal fasteners are suitable for the releasable connection in longitudinal direction with the first longitudinal fasteners and with the second flange-fasteners, wherein the first longitudinal fasteners are unsuitable for the connection with the second flange-fasteners, and the second longitudinal fasteners are unsuitable for the connection with the first flange-fasteners.

4. The cable reel of claim 3, wherein the first longitudinal fasteners and the second longitudinal fasteners, the first flange-fasteners and the second flange-fasteners comprise snap-fits.

5. The cable reel of claim 4, wherein the first longitudinal fasteners comprise a cantilever snap-fit having a cantilever beam with a tapered hook, and the second longitudinal fasteners comprise an axially protruding wall having a slit, wherein the slit of the second longitudinal fasteners is releasably engageable by the tapered hook of the first longitudinal fasteners.

6. The cable reel of claim 5, wherein the first flange-fasteners comprise an axially protruding wall having a slit, wherein the slit of the first flange-fasteners is releasably engageable by the tapered hook of the first longitudinal fasteners.

7. The cable reel of claim 5, wherein the second flange-fasteners comprise a circumferential slit, wherein the axially protruding wall of the second longitudinal fasteners is insertable, and a cantilever snap-fit having a cantilever beam with a tapered hook, wherein the slit of the second longitudinal fasteners is releasably engageable by the tapered hook of the second flange-fasteners.

8. The cable reel of claim 1, wherein the first and the second flanges are reversibly couplable in the non-working configuration.

9. The cable reel of claim 6, wherein the first flange comprises auxiliary slits where the cantilever beam of the second flange-fasteners can be inserted from an outer side of the first flange such that the hook of the second flange-fasteners engages the slit of the first flange-fasteners for reversibly coupling the first and the second flanges in a non-working configuration.

10. The cable reel of claim 1, wherein each tubular section comprises one or more axial pins on one longitudinal side and one or more axial holes on the other longitudinal side, wherein the axial pins are reversibly insertable into the axial holes, and the first and the second flanges comprise axial holes/axial pins reversibly couplable with the axial pins/axial holes of the main body tubular sections.

11. The cable reel of claim 1, wherein the arcuate sections comprise first circumferential fasteners and second circumferential fasteners, wherein the first circumferential fasteners and the second circumferential fasteners are suitable for the releasable interconnection in a circumferential direction, wherein the first and the second circumferential fasteners comprise snap-fits.

12. The cable reel of claim 11, wherein the first circumferential fasteners comprise a cantilever snap-fit having a cantilever beam with a tapered hook, and the second circumferential fasteners comprise a circumferentially protruding wall having a slit, wherein the slit of the second circumferential fasteners is releasably engageable by the tapered hook of the first circumferential fasteners.

13. The cable reel of claim 3, wherein the arcuate sections comprise first circumferential fasteners and second circumferential fasteners, wherein the arcuate sections comprise circumferential holes allowing access to inside of the tubular main body for decoupling the first longitudinal fasteners and the second longitudinal fasteners, and/or for decoupling the first longitudinal fasteners and the first flange-fasteners, and/or for decoupling the second longitudinal fasteners and the second flange-fasteners, and/or for decoupling the first circumferential fasteners and the second circumferential fasteners.

14. The cable reel of claim 1, wherein the cable reel is made of a plastic material.

15. A cable reel comprising:

a body extending along a first axis, the body comprising a plurality of tubular sections successively arranged side by side along the first axis and releasably interconnected one to another;

a first flange positioned at a first end of the body, releasably connected to a first tubular section of the plurality of tubular sections; and a second flange positioned at a second end of the body, releasably connected to a last tubular section of the plurality of tubular sections, wherein each tubular section comprises at least two arcuate sections releasably interconnected in a circumferential direction, wherein the tubular sections comprise first longitudinal fasteners and second longitudinal fasteners, the first and the second longitudinal fasteners being differently shaped, and wherein the first flange and the second flange comprise first flange-fasteners and second flange-fasteners, the first flange-fasteners and the second flange-fasteners being differently shaped.

16. The cable reel of claim 15, wherein all the arcuate sections of all the tubular sections have the same shape and the same dimension and are stackable.

17. The cable reel of claim 15, wherein the first longitudinal fasteners are suitable for the releasable connection in longitudinal direction with the second longitudinal fasteners and with the first flange-fasteners, and the second longitudinal fasteners are suitable for the releasable connection in longitudinal direction with the first longitudinal fasteners and with the second flange-fasteners, wherein the first longitudinal fasteners are unsuitable for the connection with the second flange-fasteners, and the second longitudinal fasteners are unsuitable for the connection with the first flange-fasteners.

18. The cable reel of claim 15, wherein the first and the second flanges are reversibly couplable in a non-working configuration.

19. The cable reel of claim 15, wherein the arcuate sections comprise first circumferential fasteners and second circumferential fasteners, wherein the first circumferential fasteners and the second circumferential fasteners are suitable for the releasable interconnection in circumferential direction, wherein the first and the second circumferential fasteners comprise snap-fits.

* * * * *